US010487386B2

(12) United States Patent
Kopf et al.

(10) Patent No.: US 10,487,386 B2
(45) Date of Patent: Nov. 26, 2019

(54) GALVANIZING FURNACE

(71) Applicant: Kopf Holding GmbH, Kirchheim/Teck (DE)

(72) Inventors: Willi Kopf, Kirchheim/Teck (DE); Karsten Köhler, Moritzburg (DE)

(73) Assignee: Kopf Holding GmbH, Kirchheim/Teck (DE)

( * ) Notice: Subject to any disclaimer, the term of this patent is extended or adjusted under 35 U.S.C. 154(b) by 148 days.

(21) Appl. No.: 15/496,025

(22) Filed: Apr. 25, 2017

(65) Prior Publication Data

US 2017/0349990 A1 Dec. 7, 2017

(30) Foreign Application Priority Data

Jun. 2, 2016 (DE) ..... 10 2016 110 170

(51) Int. Cl.

| | |
|---|---|
| ***C23C 2/06*** | (2006.01) |
| ***F27B 9/36*** | (2006.01) |
| ***F27B 9/14*** | (2006.01) |
| ***C23C 2/40*** | (2006.01) |
| ***F27B 9/28*** | (2006.01) |
| ***F27D 21/00*** | (2006.01) |
| ***F27B 9/40*** | (2006.01) |

(52) U.S. Cl.

CPC ..... *C23C 2/06* (2013.01); *C23C 2/40* (2013.01); *F27B 9/145* (2013.01); *F27B 9/28* (2013.01); *F27B 9/36* (2013.01); *F27B 9/40* (2013.01); *F27D 21/0021* (2013.01); *F27B 2009/3646* (2013.01)

(58) Field of Classification Search

CPC ... C23C 2/003; C23C 2/06; C23C 2/40; F27B 14/14; F27B 14/143; F27B 9/145; F27B 9/28; F27B 9/36; F27B 9/40; F27D 21/0021; F27D 99/0033

USPC ..... 266/99, 200, 242; 432/49, 146, 196

See application file for complete search history.

(56) References Cited

U.S. PATENT DOCUMENTS 1,725,974 A * 8/1929 Brautigam ..... F24H 9/0026 110/323
2,017,229 A * 10/1935 Beverley ..... C23C 2/003 126/347
2,414,860 A * 1/1947 Dobrin ..... C23C 2/003 266/242

(Continued)

*Primary Examiner* — Jessee R Roe
*Assistant Examiner* — Michael Aboagye
(74) *Attorney, Agent, or Firm* — Michael Soderman

(57) ABSTRACT

A galvanizing furnace (1) with a galvanizing vat (6) and a furnace housing (2) surrounding the galvanizing vat (6), which furnace housing has a rectangular cross-section. The furnace housing (2) has two opposite longitudinal sidewalls (4) and two opposite end walls (5) and further comprises burners for heating molten zinc in the galvanizing vat (6). In the areas of two diagonally opposite corners of the furnace housing (2), at least one first receptacle (15) is provided for a burner. In the areas of the other two diagonally opposite corners of the furnace housing (2), a second receptacle (16) is provided for a burner. The burners are arranged optionally either in the first receptacles (15) or in the second receptacles (16). Flames produced by the burners are conducted in the area between a longitudinal sidewall (4) of the furnace housing (2) and the opposite wall of the galvanizing vat (6).

3 Claims, 2 Drawing Sheets

(56) References Cited

U.S. PATENT DOCUMENTS

| | | | | | |
|---|---|---|---|---|---|
| 3,174,735 | A * | 3/1965 | McFadden | F23D 14/00 | 431/173 |
| 4,510,793 | A * | 4/1985 | Ploegaert | G01B 17/02 | 73/597 |
| 4,730,336 | A * | 3/1988 | Herneisen | C21C 5/5217 | 373/2 |
| 6,644,962 | B2 * | 11/2003 | Sugimoto | C21D 1/52 | 432/128 |
| 7,858,022 | B2 * | 12/2010 | Okada | F27B 14/0806 | 266/242 |

* cited by examiner

GALVANIZING FURNACE

CROSS REFERENCE TO RELATED APPLICATIONS

This application claims the priority of DE 102016110170.2 filed on 2016-Jun.-02; this application is incorporated by reference herein in its entirety.

BACKGROUND

The present invention relates to a galvanizing furnace and a method for operation of a galvanizing furnace.

Such galvanizing furnaces are used in hot-dip galvanizing plants and serve for heating molten zinc. The galvanizing furnace is generally comprised of a furnace housing with a galvanizing vat arranged therein. The furnace housing typically has a rectangular cross-section. For this purpose, the furnace housing has two opposite longitudinal sidewalls as well as two opposite end walls, wherein the longitudinal sidewalls are larger than the end walls.

Burners, in particular gas burners, are typically used to heat the molten zinc in the galvanizing vat. In each case, these burners heat the furnace interior by means of a flame tube between the walls of the furnace housing and the galvanizing vat. Furthermore, electrically heated galvanizing furnaces are also known.

A widely-used burner system for such galvanizing furnaces operates with gas burners in the form of high-speed burners. These high-speed burners are provided at the diagonally opposite corners of the furnace housing. In each case, the high-speed burners are supported in an end wall of the furnace housing such that the flame produced by the respective high-speed burner is conducted into the interspace between a longitudinal sidewall of the furnace housing and a wall of the galvanizing vat opposite this longitudinal sidewall. Depending on the size and output of the galvanizing furnace, also multiple high-speed burners can be installed above one another in the diagonally opposite corners of the furnace housing.

To protect against the high flame temperatures of the high-speed burner, the corner areas of the galvanizing vat, which are directly opposite the flame outlets of the high-speed burners, are clad on their outer sides with flame deflector plates and thus are protected.

During the operation of such galvanizing furnaces wear effects develop which affect particularly the galvanizing vat. It has been shown that the wall thickness of the galvanizing vat is reduced during the operation of the galvanizing furnace. With progressive wear, the galvanizing vat wall thickness is reduced to the extent that the entire galvanizing vat must be replaced, which requires costly engineering effort. It is particularly disadvantageous that this involves substantial downtimes of the galvanizing furnace, i.e. undesirably low galvanizing furnace availability.

SUMMARY

The invention relates to a galvanizing furnace (1) with a galvanizing vat (6) and a furnace housing (2) surrounding the galvanizing vat (6), which furnace housing has a rectangular cross-section. The furnace housing (2) has two opposite longitudinal sidewalls (4) and two opposite end walls (5) and further comprises burners for heating molten zinc in the galvanizing vat (6). In the areas of two diagonally opposite corners of the furnace housing (2), in each case at least one first receptacle (15) is provided for a burner. In the areas of the other two diagonally opposite corners of the furnace housing (2), in each case a second receptacle (16) is provided for a burner. The burners are arranged optionally either in the first receptacles (15) or in the second receptacles (16). Flames produced by the burners are in each case conducted in the area between a longitudinal sidewall (4) of the furnace housing (2) and the opposite wall of the galvanizing vat (6).

DETAILED DESCRIPTION

The object of the invention is to provide a galvanizing furnace and a method for its operation which increases the galvanizing furnace availability at low engineering expense.

To solve this problem, the features of the independent claims are provided. Advantageous embodiments and suitable refinements of the invention are described in the dependent claims.

The invention relates to a galvanizing furnace with a galvanizing vat and a furnace housing which has a rectangular section and encloses the galvanizing vat. The furnace housing has two opposite longitudinal sidewalls and two opposite end walls and further comprises burners for heating molten zinc in the galvanizing vat. In the areas of two diagonally opposite corners of the furnace housing, in each case at least one first receptacle for a burner is provided. In the areas of the other two diagonally opposite corners of the furnace housing, in each case at least one second receptacle for a burner is provided. The burners are optionally arranged either in the first receptacles or in the second receptacles. In each case, flames produced by the burners are conducted in the area between a longitudinal sidewall of the furnace housing and the opposite wall of the galvanizing vat.

The invention furthermore relates to a process for operating a galvanizing furnace.

With the process according to the invention, the availability of the galvanizing furnace according to the invention can be increased surprisingly easily.

The invention is based on the knowledge that the wear of the galvanizing vat is primarily due to the high temperatures produced by the burners. In that context it was determined that the greatest wear occurs in the area of the flame ejection at the respective burner or, if a flame deflector plate is arranged on the galvanizing vat, directly behind the flame ejection, i.e. the reduction in the wall thickness of the galvanizing vat is greatest in this area due to the high temperatures, whereas the wear, i.e. the reduction in the wall thickness of the galvanizing vat, decreases continuously with increasing distance to the respective burner.

With the galvanizing furnace according to the invention this circumstance is taken into account, in that first receptacles for the burners are provided not only in two diagonally opposite corner areas of the furnace housing. Receptacles for the burners are instead also provided in the two other diagonally opposite corner areas, these second receptacles being preferably identical with the first receptacles.

As a result, the burners, which are preferably designed as high-speed burners, can be optionally inserted either into the first receptacles or into the second receptacles.

The operation of the galvanizing furnace according to the invention ensues such that the galvanizing furnace is initially operated for a specified period with the burners in the first receptacles. During this phase, in the area of the flame ejection from the burners, i.e. in the area of the first receptacles, greater wear of the galvanizing vat, i.e. a greater reduction in the wall thickness, takes place. This wear decreases continuously along the respective sidewall of the galvanizing vat in the direction of the second receptacles.

After the completion of this first operating phase, the burners are exchanged, so that they are now supported in the second receptacles of the furnace housing. This exchange can be done easily and quickly, i.e. without long downtimes of the galvanizing furnace.

Because of the exchange of the burners, during the second phase increased wear occurs in those areas of the galvanizing vat which adjoin the flame ejection areas of the burners in the second receptacles. This means that the spatial wear profile in this second phase is complementary to the spatial wear profile in the first phase.

But this means that due to the exchange of the burners, uniform wear is obtained across all the sidewalls of the galvanizing vat.

This significantly increases the service life of the galvanizing vat and therefore the galvanizing furnace availability compared with traditional galvanizing furnace operation. During traditional operation, the burners would namely always be supported only in the first receptacles. In the flame ejection areas assigned to the first receptacles, this would result in a locally limited severe reduction in the wall thickness of the galvanizing vat, requiring its replacement within a relatively short period of time.

Due to the change in the mounting positions of the burners according to the invention, the service life of the galvanizing vat can be significantly increased, so that the intervals at which the galvanizing vat must be replaced with a new one can be considerably extended.

In principle, the time intervals at which the galvanizing furnace is operated with burners supported in the first receptacles or in the second receptacles, can be specified empirically.

According to a particularly advantageous embodiment of the invention, means are provided for location-dependent measurement of the wear of the galvanizing vat walls. Depending on the wear values determined, an exchange of the burners from the first receptacles to the second receptacles, or vice versa, can be carried out.

In this case, the time intervals during which the galvanizing furnace is operated with burners supported in the first receptacles or in the second receptacles can be specified depending on the wear values measured and thus be optimized.

Particularly advantageously, as a measure for the wear of the walls of the galvanizing vat, their wall thickness is recorded.

In principle, the wall thicknesses can be measured by a corresponding number of measuring points across all the sidewalls of the galvanizing vat, along which the flames of the burners are conducted.

Expediently, the actual wall thickness of the galvanizing vat is recorded in the area of the flame ejection of at least one burner. The burners are exchanged when the actual wall thickness drops below a specified limit value.

The wall thickness of the galvanizing vat can thus be measured in particularly critical areas. Because the areas of the greatest wear limit the service life of the galvanizing vat, such measurement is adequate.

According to a particularly advantageous embodiment of the invention, an ultrasonic transducer is provided for measuring the wall thickness of the galvanizing vat.

The wall thickness of the galvanizing vat can thus be measured with the ultrasonic transducer during the galvanizing furnace operation.

To carry out these measurements, closable inspection openings are advantageously provided in the longitudinal sidewalls of the furnace housing. To measure the wall thickness, the ultrasonic transducer is inserted through an inspection opening to the outside of a wall of the galvanizing vat.

By means of a suitable matrix of inspection openings, the location-dependent progression of the reduction in the wall thickness of the galvanizing vat can be accurately detected.

The measurements can be carried out easily by just one person. For this purpose, the respective person must simply open the closure of the desired inspection opening in order to introduce the ultrasonic transducer through the inspection opening into the furnace interior and then against the wall of the galvanizing vat.

The ultrasonic transducer is advantageously designed as a so-called hot tip, which is suitable for use at high temperatures as they exist in the furnace interior. The ultrasonic transducer advantageously furthermore has a magnet for enabling the ultrasound transducer to adhere to the wall of the galvanizing vat. This ensures accurate and reproducible wall thickness measurement with the ultrasonic transducer.

According to an expedient embodiment, the receptacles for the burners are in each case arranged in an end wall.

This ensures that the flames of the burners are conducted in a simple manner in the interspace between a longitudinal sidewall of the furnace housing and a wall of the galvanizing vat.

According to an advantageous refinement, multiple receptacles, in which a burner can be arranged in each case, are provided in every corner area of the furnace housing.

As a result, multiple burners can be installed in each corner area, whereby the output of the galvanizing furnace, i.e. the throughput of molten zinc per unit of time, can be increased.

Expediently, all receptacles are identically designed.

Burners of the same type can therefore be installed in any receptacles of the furnace housing.

It is furthermore advantageous that the receptacles in which no burner is arranged are tightly sealed with sealing means.

This ensures that the furnace housing forms an encapsulated unit against the ambient atmosphere.

According to an advantageous embodiment, the galvanizing vat has an essentially rectangular cross-section that matches the cross-section of the furnace housing. In every corner area of the galvanizing vat, a flame deflector plate is attached on the outside wall of the galvanizing vat.

Because the burners can be supported optionally in the first or second receptacles and can therefore be arranged in any corner area of the furnace housing, it is accordingly also expedient to protect every corner area with flame deflector plates against the flames of the burners.

Matching inspection openings are provided in the longitudinal sidewalls of the furnace housing such that the ultrasonic transducer inserted through such an inspection opening is guided directly onto a flame deflector plate adjacent to a wall of the galvanizing vat.

The ultrasonic transducer can therefore be inserted through the inspection opening directly behind the flame deflector plates to the wall of the galvanizing vat, so that a measurement can be done on the positions of the galvanizing vat that are subjected to maximum stress loads.

According to an advantageous embodiment, first temperature sensors are integrated in braces, which support a wall of the galvanizing vat against a longitudinal sidewall of the furnace housing.

These temperature sensors can therefore be used to check whether the braces are subjected to excessive temperature loads.

Further advantageous are second temperature sensors for measuring the temperature in the furnace housing interior.

Expediently, the outputs of the burners are adjusted depending upon the measured values recorded with the first or the second temperature sensors.

In this way, damage to components in the interior of the furnace housing can be avoided.

BRIEF DESCRIPTION OF THE DRAWINGS

In the following, the invention is explained with the aid of drawings, showing.

DETAILED DESCRIPTION OF THE PREFERRED EMBODIMENTS

Figure 1:
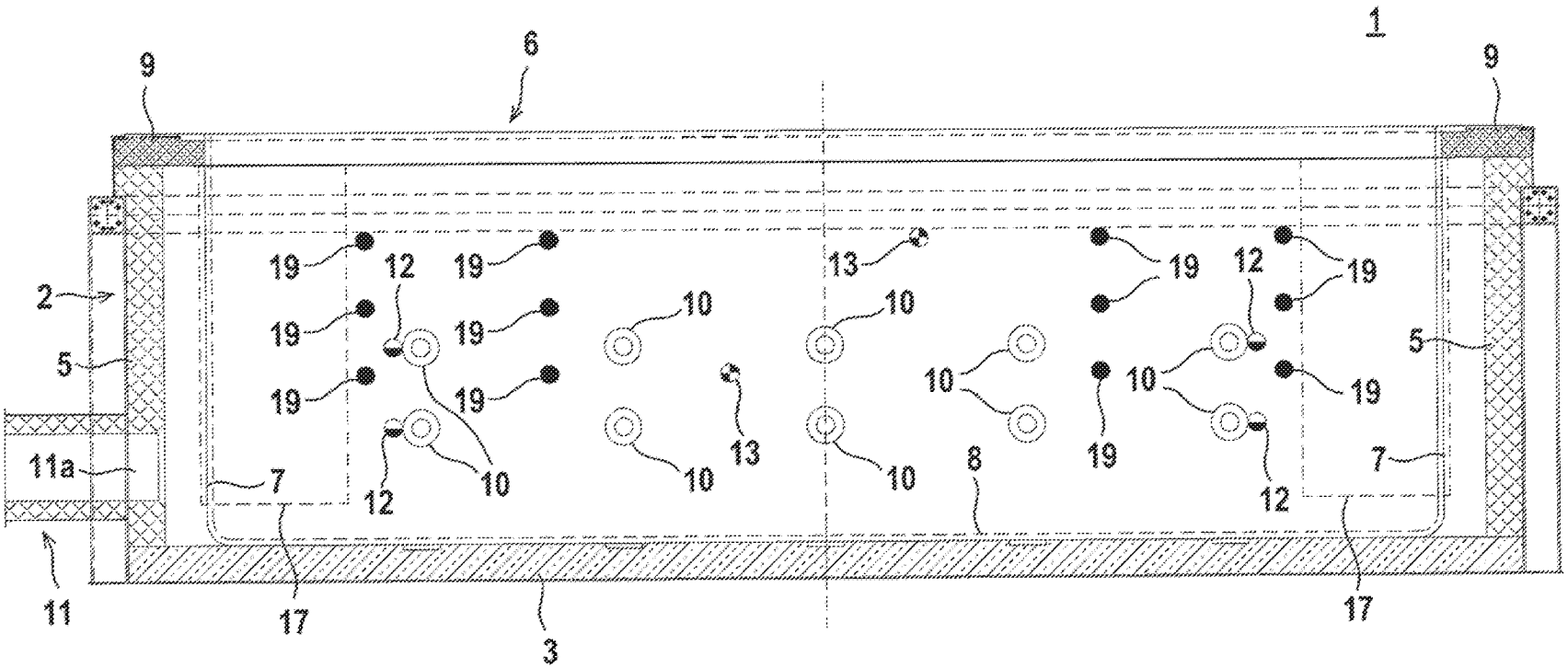
FIG. 1: A longitudinal sectional view of an embodiment of the galvanizing furnace according to the invention.
Figure 2:
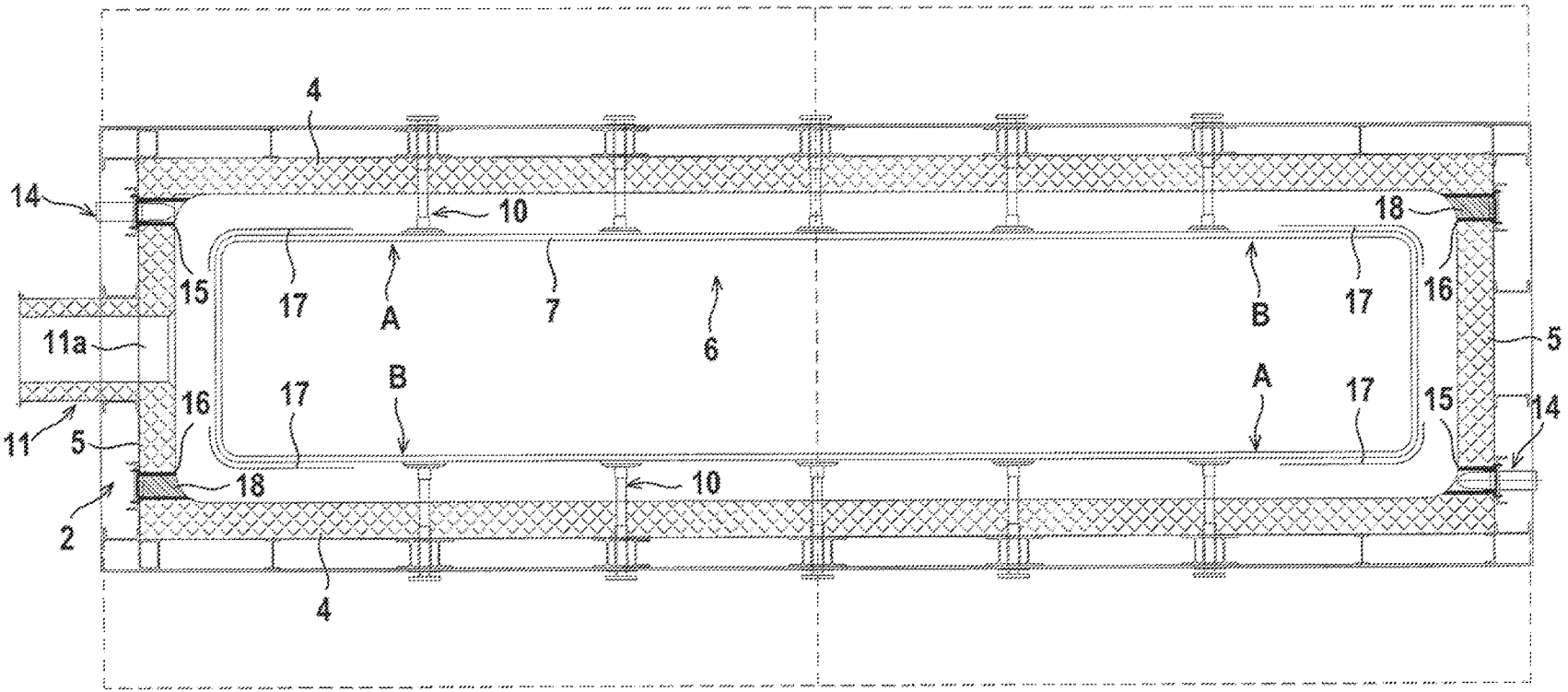
FIG. 2: A cross-sectional view of the galvanizing furnace according to FIG. 1.

FIGS. 1 and 2 illustrate an embodiment of the galvanizing furnace 1 according to the invention. The galvanizing furnace 1 has a furnace housing 2 with a floor 3 having a rectangular contour and in each case two longitudinal sidewalls 4 and two end walls 5 protruding perpendicularly from the floor 3, wherein the two end walls 5 are arranged opposite each other and the longitudinal sidewalls 4 are arranged opposite each other. The furnace housing 2 therefore has a constant rectangular cross-section over its entire height.

In the interior of the furnace housing 2, a galvanizing vat 6 is located which serves for holding molten zinc to be heated. The galvanizing vat 6 has an essentially rectangular cross-section adapted to the cross-section of the furnace housing 2, so that the sidewalls 7 of the galvanizing vat 6 are arranged at a constant distance to the longitudinal sidewalls 4 and end walls 5 of the furnace housing 2. The galvanizing vat 6 has a planar floor 8, which rests on the floor 3 of the furnace housing 2.

The upper edge of the galvanizing vat 6 is accommodated in an edge segment 9 of the furnace housing 2, which edge segment extends on the top sides of the longitudinal sidewalls 4 and of the end walls 5. The open top side of the galvanizing vat 6 can be closed with a cover [not illustrated].

The galvanizing vat 6 is supported with braces 10 against the inner sides of the longitudinal sidewalls 4 of the furnace housing 2. The braces 10 thus form a clamping frame for fixing the position of the galvanizing vat 6 in the furnace housing 2.

One end wall 5 has a flue gas discharge orifice, which is designed in the form of a flange 11 with an exhaust gas flap 11*a*. The spatial pressure of the furnace atmosphere is controlled via the exhaust gas flap 11*a*, in order to obtain an effective temperature transition to the galvanizing vat 6.

First temperature sensors 12 for measuring the temperatures in the braces 10 themselves are provided in or on the braces 10. Overheating of the braces 10 can be monitored in this way.

Furthermore, second temperature sensors 13 are located in the area of the inner sides of the sidewalls 7, for measuring the temperature in the interior of the furnace housing 2.

The first and second temperature sensors 12, 13 are advantageously in the form of thermocouples. Depending upon the measured values generated with the temperature sensors 12, 13, the heat output of the galvanizing furnace 1, and thus the temperature in the interior of the furnace housing 2, can be controlled.

The interior of the furnace housing 2 is heated by means of burners. The burners are designed as gas burners, namely in the present case as high-speed burners 14.

To support the high-speed burners 14, according to the invention first receptacles 15 are incorporated into the respective end wall 5 in two diagonally opposite corner areas of the furnace housing 2. Furthermore, second receptacles 16 are incorporated into the respective end wall 5 in the two other diagonally opposite corner areas of the furnace housing 2.

The first and second receptacles 15, 16 are designed identically and are matched to the physical size of the high-speed burners 14, so that the high-speed burners 14 can optionally be installed in first or second receptacles 15, 16.

FIG. 2 illustrates a receptacle 15, 16 in each corner area. In principle, multiple identical first receptacles 15 or second receptacles 16 can be arranged spaced apart above each other in each corner area, so that a high-speed burner 14 can be supported in each of these receptacles 15, 16 of a corner area.

According to the invention, the high-speed burners 14 are inserted either only in the first receptacles 15 or in the second receptacles 16, in order to heat the interior of the furnace housing 2 in this way.

Because the high-speed burners 14 can be installed in every corner area of the furnace housing 2, as shown in FIGS. 1 and 2, the outside walls of the galvanizing vat 6 are clad in all corner areas with flame deflector plates 17, in order to protect the walls of the galvanizing vat 6 against the flames emerging from the high-speed burners 14. The identically designed flame deflector plates 17 extend across the entire height of the galvanizing vat 6.

In the configuration illustrated in FIG. 2, the high-speed burners 14 are arranged in the first receptacles 15. The second receptacles 16, in which no high-speed burners 14 exist, are tightly sealed with sealing means 18, so that the furnace walls are tightly encapsulated. The sealing means 18 can in each case be formed from furnace insulation material and a cover plate.

If the galvanizing furnace 1 is operated with the burner configuration according to FIG. 2, the flames of the high-speed burner 14 are in each case conducted in the interspaces between a longitudinal sidewall 4 of the furnace housing 2 and a wall of the galvanizing vat 6, and as a result the molten zinc in the vat is heated.

According to the type of installation of the high-speed burners 14 in the first receptacles 15, the flame temperature is highest in the discharge area of the high-speed burner 14 (designated A in FIG. 2) and then decreases continuously towards the area at the other end of the furnace housing 2 (designated B in FIG. 2).

Accordingly, during the operation of the galvanizing furnace 1 with the burner configuration according to FIG. 2, the highest wear of the galvanizing vat 6 occurs in area A, which wear consists of a reduction of the wall thickness of the galvanizing vat 6. The reduction of the wall thickness then decreases continuously from area A to area B.

During the operation of the galvanizing furnace 1, the reduction of the wall thickness due to wear is preferably recorded metrologically at regular time intervals.

For this purpose, identical configurations of inspection openings 19 are incorporated into the longitudinal sidewalls 4 of the furnace housing 2, which inspection openings can be closed with covers (not illustrated separately).

Ultrasonic transducers (not shown) are provided for carrying out non-contact measurement of the wall thickness of the galvanizing vat 6 during the operation of the galvanizing furnace 1. To carry out such measurement, the cover is removed from an inspection opening 19, and the ultrasonic transducer is then inserted through the inspection opening 19 to the wall of the galvanizing vat 6, where the ultrasonic transducer preferably adheres by means of an integrated magnet in a defined measuring position on the wall of the galvanizing vat 6.

As can be seen from FIG. 1, four rows of inspection openings 19 are provided, with in each case three inspection openings 19 arranged one above the other. The two outer rows are arranged directly following the flame deflector plates 17. Furthermore, two central rows of inspection openings 19 are provided.

By inserting ultrasonic transducers through the inspection openings 19, the wall thickness of the galvanizing vat 6 can be detected and spatially resolved, while the galvanizing furnace 1 is being operated. In particular, by inserting the ultrasonic transducers through the left-hand row of inspection openings 19, the wall thickness of the galvanizing vat 6 can be measured in area A, where the greatest wear of the galvanizing vat 6 is encountered.

In particular, when it is determined in this critical area A that the wall thickness of the galvanizing vat 6 has dropped below a critical value, the mounting locations of the high-speed burners 14 are preferably exchanged during the next maintenance period of the galvanizing furnace 1 such that the high-speed burners 14 are dismantled from the first receptacles 15 and are then installed in the second receptacles 16. The first receptacles 15 are then appropriately sealed with the sealing means 18.

Because in the subsequent operation of the galvanizing furnace 1 the high-speed burners 14 are now installed in the second receptacles 16, the areas B are then subjected to the greatest wear. The areas A, which were still subjected to heavy wear during the first operating phase are protected, however, since the flame temperatures of the high-speed burners 14 are now lower at those points. Therefore, in spite of the heavy wear that occurred in the galvanizing vat 6 in the areas A during the first phase, the galvanizing furnace 1 can continue to be operated without risk of damage, because in the second phase only slight wear still occurs in the areas A with the high-speed burners 14 being arranged in the second receptacles 16. The galvanizing furnace 1 can therefore continue to be operated without risk of damaging the galvanizing vat 6, until a reduction in the wall thickness in the areas B of the galvanizing vat 6 also occurs up to the limit value. In this context, the wall thickness of the galvanizing vat 6 is checked again by the measurements carried out with the ultrasonic transducers. This significantly increases the service life of the galvanizing furnace 1 with the galvanizing vat 6, compared with an operation in which the high-speed burners 14 are permanently arranged only in the first receptacles 15.

LIST OF REFERENCE NUMERALS (1) Galvanizing furnace
(2) Furnace housing
(3) Floor
(4) Longitudinal sidewall
(5) End wall
(6) Galvanizing vat
(7) Sidewall
(8) Vat floor
(9) Edge segment
(10) Brace
(11) Flanges
(11*a*) Exhaust gas flap
(12) First temperature sensor
(13) Second temperature sensor
(14) High-speed burner
(15) First receptacle
(16) Second receptacle
(17) Flame deflector plate
(18) Sealing means
(19) Inspection opening

The invention claimed is:

1. A method for operating a galvanizing furnace (1); said furnace comprising: a galvanizing vat (6) and a furnace housing (2) surrounding the galvanizing vat (6), which furnace housing has a rectangular cross-section, wherein the furnace housing (2) has two opposite longitudinal sidewalls (4) and two opposite end walls (5), and with a burner for heating molten zinc in the galvanizing vat (6), characterized in that in areas of two diagonally opposite corners of the furnace housing (2) in each case one first receptacle (15) for the burner is provided, in areas of other two diagonally opposite corners of the furnace housing (2) in each case a second receptacle (16) for the burner is provided, and that the burner is arranged in a choice of either the first receptacle (15) or, alternatively, in the second receptacle (16), wherein flames produced by the burner are conducted in an area between a longitudinal sidewall (4) of the furnace housing (2) and an opposite sidewall of the galvanizing vat (6), comprised of the following method steps:

operation of the galvanizing vat during a first operating phase with the burner in the first receptacle, detection of a current wall thickness of the galvanizing vat in proximity of flame ejection of the burner, removal of the burner from the first receptacle and installation in the second receptacle when the current wall thickness goes below a specified limit value, operation of the galvanizing vat during a second operating phase with the burner in the second receptacle.

2. The method according to claim 1, characterized in that, in addition to the first receptacle and the second receptacle, a plurality of further receptacles and a plurality of further burners are provided.

3. The method according to claim 1, characterized in that an ultrasonic transducer is provided for measuring the wall thickness of the galvanizing vat (6).

* * * * *